US005202226A

United States Patent [19]

Saitou

[11] Patent Number: 5,202,226

[45] Date of Patent: Apr. 13, 1993

[54] PROCESS FOR PRODUCING SILVER HALIDE EMULSION

[75] Inventor: Mitsuo Saitou, Kanagawa, Japan

[73] Assignee: Fuji Photo Film Co., Ltd., Kanagawa, Japan

[21] Appl. No.: 921,604

[22] Filed: Aug. 3, 1992

Related U.S. Application Data

[63] Continuation of Ser. No. 565,093, Aug. 10, 1990, abandoned.

[30] Foreign Application Priority Data

Aug. 10, 1989 [JP] Japan ..... 1-207513
Jul. 17, 1990 [JP] Japan ..... 2-188243

[51] Int. Cl.[5] ..... G03C 1/015
[52] U.S. Cl. ..... 430/569; 430/567
[58] Field of Search ..... 430/567, 569

[56] References Cited

U.S. PATENT DOCUMENTS 3,790,386 2/1974 Posse et al. ..... 430/642
4,879,208 11/1989 Urabe ..... 430/569

FOREIGN PATENT DOCUMENTS 0359507 3/1990 European Pat. Off. ..... 430/567
2556884 6/1976 Fed. Rep. of Germany ..... 430/567
1243356 8/1971 United Kingdom ..... 430/567

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A process and apparatus for mass-producing a silver halide emulsion for photographic light-sensitive materials which includes carrying out the nucleation of the silver halide grains in a reaction apparatus having a middle capacity and carrying out physical ripening and/or the crystal growth in a reaction apparatus having a larger capacity than the middle capacity reaction apparatus. Another reaction apparatus having a larger capacity than the middle capacity reaction apparatus can be used to store nuclei formed in the middle capacity reaction apparatus before transfer of the nuclei to the other reaction apparatus having a large capacity in which physical ripening and/or the crystal growth are carried out.

12 Claims, 3 Drawing Sheets

PROCESS FOR PRODUCING SILVER HALIDE EMULSION

This is a continuation of application Ser. No. 07/565,093 filed Aug. 10, 1990, now abandoned.

FIELD OF THE INVENTION

This invention relates to a silver halide emulsion for photographic light-sensitive materials, and more particularly to a process of mass-producing the aforesaid silver halide emulsion with good reproducibility.

BACKGROUND OF THE INVENTION

In order to obtain larger quantities of a silver halide emulsion having excellent properties as manufactured in a small scale reaction apparatus used for experimental research (usually form 1 to 5 liters in capacity), it is necessary to increase the production scale for the silver halide emulsion to a middle volume (usually, producing in a reaction vessel of from 10 to 150 liters). If the emulsion having the desired performance can be produced in the reaction vessel of the middle volume, it is necessary to increase then the production scale of the emulsion to a large volume (usually form 200 to 2,000 liters). When a silver halide emulsion is produced according to a same production procedure, the performance of the silver halide emulsion produced in a reaction apparatus of the small volume frequently coincides with the performance of the silver halide emulsion produced in a reaction apparatus of the middle volume but does not frequently coincide with the performance of the silver halide emulsion produced in a reaction vessel of the large volume.

Accordingly, in the instance of mass-production, the production procedure for the silver halide emulsion is frequently corrected to the extent necessary to make the properties of the silver halide emulsion in a large scale production coincide with the properties obtained in small scale production. However, such corrective efforts are expensive and time-consuming.

The reason is that a silver halide emulsion is conventionally produced by the following method.

That is, (1) the nucleation, (ripening), and the crystal growth are carried out in a same reaction vessel. Hitherto, the production of silver halide emulsions is mainly carried out by the aforesaid method. In this case, there is a case of producing the silver halide emulsion through a ripening step and without passing through a ripening step.

(2) A system of after carrying out the seed crystal formation, placing a part of the seed crystals in a reaction vessel to perform the crystal growth. For example, in Example 1 of U.S. Pat. No. 4,067,739, seed crystals are formed by the steps of nucleating, ripening, and emulsion washing, and a part of the seed crystals is used for the crystal growth. Also, in Examples 7 to 11 of U.S. Pat. No. 4,797,354, after nucleation, using a part thereof, a silver halide emulsion is produced through the steps of ripening and crystal growth. However, in each case, the production of the silver halide emulsion is carried out in a reaction vessel of a same volume level and the nucleation step and the crystal growth step are not carried out in different reaction vessels each having a different volume. Also, in the aforesaid systems, a part of the nucleated emulsion or the seed crystal formed emulsion is utilized.

Also, the problem in a reaction apparatus of a large volume is mainly in that an aqueous silver salt solution and an aqueous halide solution are added as thick bundles of stream but the countermeasure for the problem are not employed.

SUMMARY OF THE INVENTION

The present invention solves the aforesaid problem and thereby provides an improved mass-production process for silver halide emulsions.

The object of this invention is, therefore, to provide a mass-production process for a silver halide emulsion capable of producing large quantities of a silver halide emulsion in a large scale apparatus by a simple manner with good reproducibility, wherein the properties of the silver halide emulsion are the same as properties of the silver halide emulsion as produced in a small scale reaction apparatus using the same production procedure.

More specifically, the present inventors have discovered that the aforesaid object of this invention can be attained by (1) carrying out the nucleation of silver halide grains in a reaction vessel of a middle volume (hereinafter referred to as a middle scale apparatus) and carrying out the crystal growth and/or physical ripening of the silver halide grains in a large scale apparatus.

(2) The process of producing a silver halide emulsion described in aftersaid item (1), wherein the nucleus emulsion formed in the reaction apparatus of the middle capacity (hereinafter referred to as middle scale apparatus) is transferred into an intermediate vessel having a large capacity, the nucleation and the transfer are repeated twice or more to accumulate a large amount of the nucleus emulsion in the intermediate vessel, and then the emulsion is transferred into the reaction apparatus having a large capacity.

(3) The process of producing a silver halide emulsion described in aforesaid item (2), wherein the temperature of the intermediate vessel of a large capacity (hereinafter referred to as large scale vessel) is kept at from 10° to 45° C. and the temperature of the reaction apparatus of a large capacity (hereinafter referred to as large scale apparatus) is kept at from 40° to 80° C.

(4) The process of producing a silver halide emulsion described in aforesaid item (2), wherein the nucleation is carried out at a low temperature by an equilibrium simultaneous double jet method of an aqueous silver salt solution and an aqueous halide solution, and the equilibrium simultaneous double jet method is carried out by a flow rate controlling method without using a silver potential controlling method.

(5) The process of producing a silver halide emulsion described in aforesaid item (2), wherein in the nucleation and the crystal growth, the aqueous silver salt solution and the aqueous halide solution are added through a porous material.

(6) The process of producing a silver halide emulsion described in aforesaid item (2), wherein the silver halide emulsion produced contains silver halide grains wherein at least 70% of the total projection area of the silver halide grains are composed of tabular silver halide grains having parallel twin planes.

DETAILED DESCRIPTION OF THE INVENTION

Figure 1:
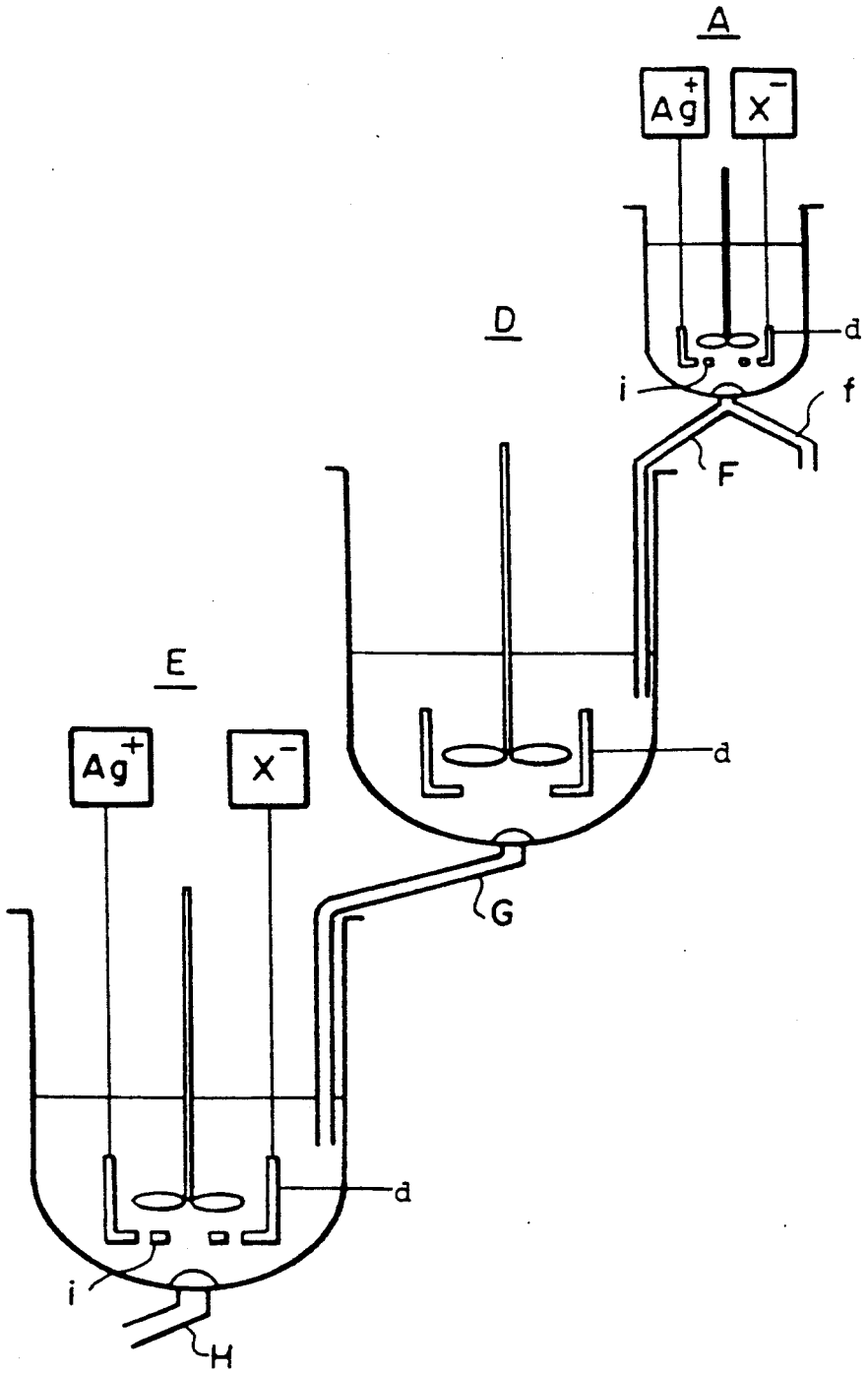
FIG. 1 is a schematic view showing an example of the relation of a middle scale apparatus, a large scale vessel, and a large scale apparatus in this invention.

When the production scale of silver halide emulsion is increased from a small scale to a large scale, it frequently happens that the performance of the silver halide emulsion produced in the small scale production does not coincide with that of the emulsion produced in the large scale production, and the main reason thereof is considered to be in the nucleation step. Usually, the nucleation period of silver halide grains is frequently not longer than 1/10 of the total silver halide grain forming period and in particular, in high-sensitive tabular silver halide grains having parallel twin planes, the former period is from 1/30 to 1/300 of the latter period. Accordingly, there is a relation that (the time of carrying out n times the nucleation in a middle scale apparatus and accumulating the nucleus emulsion formed by n time nucleations) is shorter than (the time for the physical ripening and crystal growth of the emulsion).

Thus, the aforesaid problem is solved by carrying out n times the nucleation in middle scale apparatus, accumulating the nucleus emulsion formed by the n times nucleations, transferring the accumulated emulsion into a large scale apparatus, and carrying out the ripening and crystal growth in this apparatus.

In this case, however, the accumulated emulsion can be stored in a refrigerator, etc., but there are a problem on the storage stablity of the emulsion and a problem of increasing the number of steps such as a redissolving step, etc. Accordingly, it is more preferred that the emulsion is accumulated in a vessel of large capacity and, after accumulation, immediately transferring the emulsion into the large scale apparatus.

It is preferred that the large scale vessel is kept at a low temperature. On the other hand, according to the inventors' investigation, it has been confirmed that the problem on the large scale apparatus is mainly in the point that an aqueous silver salt solution and an aqueous halide solution are added as big flow stream bundles. Accordingly, the problem is solved by adding these solutions through a porous material. Furthermore, the aforesaid problem is also solved by adding very fine silver halide grains previously prepared.

In the silver halide emulsion production process of this invention, x, i.e., (the ripening and/or crystal growing period)/(the nucleation period) is 5 or larger, and more preferably x is from 10 to 300.

The middle scale apparatus and the large scale apparatus in this invention is in the relation that y, i.e., (the capacity of the large scale apparatus)/(the capacity of the middle scale apparatus) is 3 or larger, and more preferably form 5 to 50. The capacity of the middle apparatus is from 5 to 500 liters, and preferably from 30 to 200 liters, the capacity of the large scale apparatus is at least 200 liters, and preferably 500 to 2,000 liters, and the capacities of these apparatus can be properly selected according to the aforesaid relation. The large scale vessel in this invention is a vessel which can accumulate n times of the nucleus emulsion, and it is usually at least 200 liters, preferably 200 to 1000 liters.

The production steps for making a silver halide emulsion in the process of the present invention is composed of a nucleation step and a ripening and/or crystal growing step, and then the formation of new stable nuclei is completed in the crystal growing step. In other words, new stable nuclei of silver halide grains are not substantially formed during the ripening and/or crystal growing step. In this case, the term "not substantially formed" means that new stable nuclei are formed in an amount of less than 20%, and preferably less than 10% of the total projected areas of the silver halide grains in the silver halide emulsion.

The process of the present invention is explained in greater detail below with respect to each production step (nucleating, ripening and crystal growth) for manufacturing the silver halide emulsions.

Nucleating Step

In the present invention, the nucleation step for silver halide grains is carried out in a middle scale apparatus and the reason thereof is as follows.

(1) A step of requiring highly precise control of a supersaturation degree in the formation of silver halide grains is a nucleation step. The reason is as follows. When lattice defects such as twin planes, transition lines, etc., form in the silver halide crystals in the nucleation step, these twin planes and transition lines then usually propagate with the growth of the crystals without being eliminated in the subsequent crystal growing step. Also, the formation and the characteristics of the silver halide grains being finally obtained are influenced by these defects. For example, the relation between the number or the manner of forming of twin planes in one silver halide grain and the form of the grain is described in E. Klein, H. J. Metz, and E. Moisar, *Phot. Korr.*, 99, 99–102(1963) and ibid., 100, 57–71(1964).

Accordingly, for forming silver halide grains having the desired form and characteristics, it is important to first precisely control various supersaturation factors during nucleation and then control the number of these defects being formed in the nuclei formed.

For example, for forming monodisperse hexagonal tabular silver halide grains (hexagonal tabular grains having two twin planes being parallel to each other in one silver halide grain), it is necessary to control various supersaturation factors (e.g., the $Br^-$ concentration, gelatin concentration, etc., in the reaction solution) which influence the probability of the formation of twin planes during nucleation to an extent which neither too high and too low such that the possibility of forming two twin planes in one silver halide grain is increased. Also, for example, when solutes are continuously added under similar conditions during 0 to 4 minutes of the nucleation period, with the increase of the nucleation period, the ratio of the number of twin planes to grain is increased. Hence, in such a case, it is necessary to control the nucleating period together with the other aforesaid factors.

Detailes of the aforesaid matters are described in Japanese Patent Application No. Sho-63-315741 and JP-A-63-92942 (the term "JP-A" as used herein means an "unexamined published Japanese patent application").

Also, for forming silver halide grains having no defects (i.e., silver halide grains containing neither twin planes nor transition lines), it is necessary to control the various saturation conditions at the nucleation to the extent necessary to selectively form silver halide grain containing neither twin planes nor transition lines. Details thereof are described in Japanese Patent Application No. Sho-63-223739.

For precisely controlling the supersaturation at the nucleation, it is preferable that the reaction vessel has a small capacity. This is because the circulation frequency of the reaction solution in the reaction vessel is high, whereby the aqueous solution of silver nitrate and the aqueous solution of halide(s) added are quickly and uniformly mixed with the whole reaction solution.

(2) A research study for the improvement of silver halide emulsions is usually carried out in a small scale research apparatus having a capacity of from 1 to 5 liters. When the silver halide is mass-produced in a large scale apparatus using stable nuclei formed previously in the aforesaid small scale research apparatus or stable nuclei formed in a middle scale apparatus having a capacity of larger than the aforesaid research apparatus but within about 50 times the capacity of the aforesaid small scale research apparatus, the properties of the silver halide emulsion produced in the large scale apparatus coincide well with those of the silver halide emulsion produced in the small scale apparatus since the most important step of forming the silver halide grains is same or almost the same in both the production processes.

(3) The period of forming stable nuclei for silver halide grains is usually from about 5 seconds to about 10 minutes, which is considerably shorter than the whole production period of the silver halide emulsion. In particular, in the case of forming tabular silver halide grains, the saturation degree at the nucleation is high and many stable nuclei are formed, and also the sizes of the nuclei are preferably smaller for quickly progressing the subsequent ripening step. Thus, the nucleation period is usually from about 5 seconds to about 2 minutes, which is a relatively very short period. Thus, in such a case, when the step of forming the nuclei in a middle scale apparatus and transferring the reaction solution formed in the small scale apparatus into a large scale vessel is repeatedly carried out, a long duration of time is not required. Accordingly, the process of this invention is particularly suitable for producing a tabular grain silver halide emulsion.

In regard to the middle scale apparatus for the nucleation, the relation between the middle scale apparatus and a large scale apparatus is explained in greater detail below.

The embodiment of the middle scale apparatus is classified into batch system and multistage batch system described below.

1) Batch system

Nuclei are formed (nucleation) in the middle scale apparatus and after finishing the nucleation, the reaction solution formed is transferred into a large scale vessel. With a capacity of the middle scale apparatus to the capacity of the large scale apparatus of 1/n, the aforesaid operation is repeated n times.

As shown in FIG. 1, one large scale vessel D is disposed between a middle scale apparatus A and a large scale apparatus E. While performing ripening and crystal formation in the large scale apparatus E, the nucleation is performed n times in the middle scale apparatus A and the sequentially discharged reaction solution is stored in the large scale vessel D. After finishing the reaction in the large scale apparatus E, and finishing washing of the apparatus, the reaction solution in the large scale vessel D is transferred into the large scale apparatus E. Then, the ripening and crystal formation reactions are performed in the large scale apparatus E. In this manner, by only employing one large scale vessel, there is an advantage that the waiting time for collecting the reaction solution from the small scale apparatus can be almost eliminated.

It is preferred that an aqueous gelatin solution being added to the vessel at the nucleation is added as a solution previously kept at the nucleation temperature, whereby the repetition of the nucleation can be quickly carried out.

Furthermore, for efficiently carrying out the aforesaid step, the following descriptions can be referred to.

(a) The value of n is reduced. That is, the capacity of the middle scale apparatus is increased within the range capable of preparing the silver halide emulsion having the same characteristics as those of the silver halide emulsion prepared in a smaller scale research apparatus. Usually, when the capacity of the reaction vessel is increased to about 100 liters, the silver halide emulsion having the same characteristics can be easily prepared. Accordingly, the value of n can be at least 2, preferably from 3 to 30, more preferably 5 to 20 in this invention. In addition, the maximum value of n is the large scale apparatus capacity to the middle scale research apparatus capacity.

This is because if the capacity of the small scale apparatus is smaller than the capacity of the small scale research apparatus, the value of n is increased to increase the number of operation times, which has no benefit. Also, if the minimum value of n is smaller than 2, the capacity of the small scale apparatus becomes too large so as to undesirably reduce the effect of this invention.

(b) Two or more of the middle scale apparatuses are used in parallel. If two middle scale apparatuses each having the same capacity are used in parallel, the operation times for the nucleation is reduced to n/2. That is, if m middle scale apparatuses having the same capacity are used, the operation iterations or runs needed for nucleation step in the small scale apparatus is reduced to n/m. The value of m is preferably from 1 to 30, and more preferably from 1 to 10. As the value of m is larger, the time for the nucleation becomes shorter but the number of the apparatuses is increased to thereby increase the production cost.

2) Multistage batch system

Figure 2:
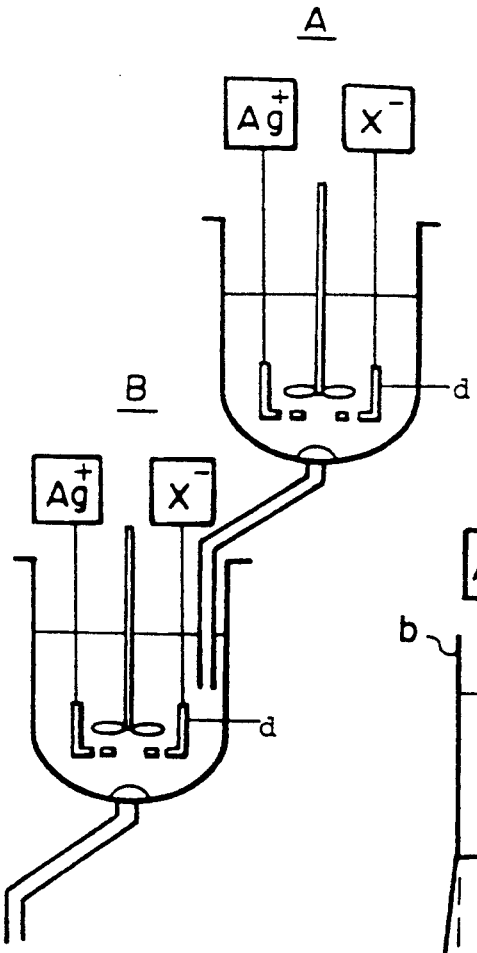
FIG. 2 is a schematic view showing a cascade multistage batch type small scale apparatus.

As shown in FIG. 2, the total nucleation state is divided into l stages and in each stage, the nucleation is carried out for a period of about 1/l of the nucleation period t. For the sake of simplicity only, middle scale apparatuses A and B only are shown in FIG. 2. The use of a greater number of apparatuses is within the scope of the present invention. It is preferred that the capacity of the middle scale apparatus A is same as that of the apparatus B.

The operation procedure is as follows.

A reaction solution is placed in the middle scale apparatus A and the nucleation is carried out for a time of about t/2. Thereafter, the solution in the apparatus A is transferred into the middle scale apparatus B and a fresh reaction solution is placed in the apparatus A. Then, the nucleation was carried out for a time of about t/2 in each of the apparatuses as A and B. Thereafter, the solution in the apparatus B is transferred into a large scale apparatus (not shown), the solution in the apparatus A is transferred into the apparatus B and a fresh reaction solution is supplied to the apparatus A. Then, the aforesaid operation is repeated until a definite amount of a silver halide emulsion is stored in the large scale apparatus.

In addition, as a matter of course, the nucleation reaction in the apparatus B may start once the reaction solution in the apparatus B is transferred into the large scale apparatus and after the reaction solution in the apparatus A is transferred into the apparatus B without awaiting the supply of a fresh reaction solution in apparatus A.

The aforesaid multistage batch system has the advantage that wash step for each middle scale apparatus after nucleation is unnecessary as compared to the case of using middle scale apparatus independently as described in the batch system 1).

For example, as compared to the batch system 1), the sizes of the stable nuclei after the nucleation in the apparatus A are those of the final nuclei. When the reaction solution partially remains as a residue in the apparatus A after transferring the reaction solution into the apparatus D, the remaining stable nuclei further grow in the subsequent nucleation procedure performed in apparatus A and the difference of the sizes of the nuclei thus grown and the sizes of newly formed stable nuclei becomes large. When the sizes of such residual remaining stable nuclei are relatively large, the difference in nuclei sizes becomes even greater in the comingled nuclei present after the next nucleation procedure performed in apparatus A. Thus, in such a case, a vessel wash step is necessary after every single step of nucleation. On the other hand, in the case of the system shown in FIG. 2, since the nucleation time in the middle scale apparatus A is t/2, the sizes of nuclei after the nucleation in the apparatus A are smaller than the sizes of the stable nuclei being finally obtained. Accordingly, even when a small amount of the reaction solution residue remains in the apparatus A after transferring the reaction solution in the apparatus A to the apparatus B, the influence of the remaining nuclei on the size distribution of the nuclei in the subsequent nucleation in the apparatus A is less. As the value of l is larger, the influence of the remaining nuclei is less. Accordingly, in the system of FIG. 2, a wash step of the apparatus after nucleation is unnecessary.

The aforesaid system 2) is effective for the case in which the total nucleation time is longer than one minute, and preferably longer than 2 minutes. When the aforesaid system 2) is applied to the case wherein the total nucleation time is under one minute, the ratio of the transferring time for transferring the reaction solution from the middle scale apparatus A to the middle scale apparatus B, and from the apparatus B to the large scale apparatus is increased as compared to the nucleation time, which is disadvantageous. Accordingly, the upper limit of l is preferably $t/l \geqq 30$ seconds. In addition, in this case, two or more multistage batch systems as shown in FIG. 2 can be also employed in parallel. In this case, the number of the systems is preferably not more than 10. This is because with the increase of the number of the systems, the nucleation time may be shortened but the equipment cost is increased.

Figure 3:
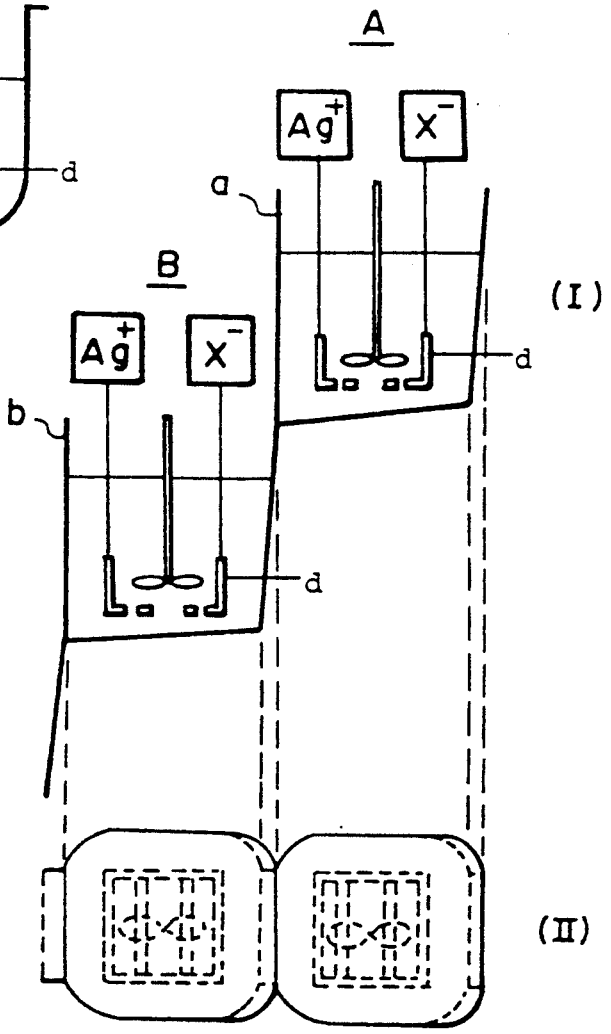
FIG. 3 is a schematic view showing a stepwise multistage type small scale apparatus.

As other multistage batch system of this invention, there is an embodiment shown in FIG. 3.

FIG. 3 (I) is a side view of the embodiment and FIG. 3 (II) is a front view thereof. In this case, liquid-supply pipes are omitted and slant side walls (a) and (b) of vessels A and B and the bottoms of the vessels function as liquid-supply pipes. Thus, the system has the advantage that no liquid remains in liquid-supply pipes and each solution can be quickly supplied.

The operation procedure in the system is same as the case of FIG. 2. Furthermore, in the aforesaid system, a system of opening or closing the liquid transferring paths by moving the side walls (a) and (b) up and down or moving out and in the sidewise directions, or a system of equipping a switch valve to the lower portion of each of the side walls (a) and (b) may be employed.

In the present invention, according to each purpose, the aforesaid systems 1) and 2) can be used singly or together considering the merit and defect of each of the systems. For example, the process of this invention is effective in the case of mass-producing, in particular, tabular grain monodisperse silver halide emulsions and in this case, the nucleation time is usually within about 3 minutes, which is short. Accordingly, the system 1) is most preferred since the ratio (liquid transfer time/nucleation time) can be reduced and the apparatus arrangement is simple.

Other preferred embodiments of the aforesaid apparatus and operation conditions are further explained below.

In the embodiments shown by FIG. 1, as a system of transferring the reaction solution from the middle scale apparatus to the large scale vessel or the large scale apparatus, a system of transferring the solution by gravitational falling by opening a valve arranged in the bottom of the middle scale apparatus is preferred since the liquid transfer can be particed most simply and at a low cost.

Also, in the case of the cascade system as shown in FIG. 1, the apparatus can be easily assembled by utilizing the slope of an inclinded support surface.

In other method for transferring the solution, the solution can be transferred using a pump. This method can be preferably used when all the apparatus are disposed on a same floor and, thus, natural gravity can not be utilized.

Also, a step of washing the middle scale apparatus and the liquid-supply pipe after transferring the reaction solution from the middle scale apparatus can be optionally employed. Furthermore, for reducing the liquid transferring time, as a matter of course, the inside diameter of the liquid-supply pipe may be increased and the length thereof is reduced to as short as possible.

It is undesirable that during the n times repeated operation of carrying out the nucleation in the middle scale apparatus and transferring the reaction solution obtained in the middle scale apparatus into the large scale vessel, the nuclei are changed by causing physical ripening in the large vessel. Thus, it is preferred to keep the temperature of the reaction solution during the temporary storage in the first large scale apparatus at a low temperature for preventing the nuclei from being changed during storage. The storage temperature is preferably from 10° to 45° C., and more preferably from 15° to 40° C.

Also, in order to keep the reaction solution at a uniform temperature, the solution may be agitated or stirred.

The system of employing the second or additional large scale vessel as described in the aforesaid system 1) has the following advatages.

Specifically, in the formation of tabular silver halide grains, the reaction solution is physically ripened at an elevated temperature after both the nucleation step in the middle scale apparatus and temporary storage in the first large scale apparatus. Thus, if the second or additional large scale vessel is not employed, the first large scale apparatus, which has been previously cooled to a low temperature for purposes of storing the accumulating nuclei, must have the temperature thereof raised in order to perform ripening. On the other hand, when the second or additional large scale vessel is employed, the first large scale vessel may be constantly maintained at a low temperature and thus the temperature raising step in the first nuclei storing large scale apparatus is not necessary. That is, in this case, since the second or additional large scale apparatus is not required to be cooled to a low temperature, after transferring the solution to the second large scale apparatus, the solution can be immediately ripened at a high-temperature state therein. Thus, the system has advantages in the points of energy saving and speed of operation.

Usually, the temperature of the large scale apparatus is kept at least 40° C., and preferably form 50° to 80° C.

In this invention, it is preferred that the liquid-contact portions of the middle scale apparatus are preferably made of a material having a contact angle with solution of larger than 90° (e.g., Teflon or a material coated with Teflon). This is because the interaction between the reaction solution and the wall of the vessel is reduced, and, therefore, the amount of the solution remaining after transferring the solution to the large scale vessel can be reduced. The liquid-contact portions composed of Teflon or a Teflon-coated material are also preferred due to the acid resistance, alkali resistance, and staining prevention with impure metals derived therefrom.

In a conventional apparatus, all steps of from a nucleation reaction to crystal growth are usually carried out in one reaction vessel. Thus, the amount of the reaction solution at the nucleation is frequently controlled to less than ⅛ of the volume of the reaction solution. In this case, when the solution is stirred vigorously, the reaction solution becomes bubbly to reduce the stirring effect. However, the middle scale apparatus in this invention is used for nucleation only, thereby it is unnecessary to allocate space for the crystal growth. Accordingly, the amount of the reaction solution in the small scale apparatus during nucleation can be increased, whereby the reaction can be stirred more vigorously and uniform nuclei can be formed. Also, more nuclei are formed by one reaction. The amount of the reaction solution is preferably from 25 to 90%, and more preferably from 50 to 90% of the capacity of the middle scale apparatus.

In other embodiment, the number of parallel twin grain nuclei can be increased by increasing the nucleation duration within the period of generating new nuclei. In other embodiment, more parallel-twinned-nuclei are preferably formed by increasing the nucleation period because the twinning is still continuing for several minutes after completion of generating new nuclei.

Usually, the addition of an aqueous silver salt and an aqueous solution of a halide or halides at the nucleation is more preferably carried out by the addition of an aqueous solution of a predetermined amount of silver salt and an aqueous solution of a predetermined amount of halide than by a controlled double jet method according to a silver potential controlling system. Practically, it means, for example, that an aqueous solution of 1 mol/liter of silver nitrate and an aqueous solution of 1.1 mol/liter of potassium bromide are added for 5 minutes at 10 ml/minute each by an equilibrium simultaneous double jet method. This is because when silver halide grains do not exist or exist in only a slight amount in the reaction vessel, the silver potential is unstable and the precision of controlling silver concentration is not good.

Also, when the production scale is increased, the ununiformity of the silver ion concentration is increased, thereby the unstability of the silver potential is more increased. Accordingly, from this point, it is also preferred to carry out it without using a silver potential control.

The nucleation step is for the formation of stable nuclei and the step may include a small degree a crystal growing. When an aqueous silver salt solution and an aqueous halide solution are added by a double jet method at equivalent rate, the generation of new stable nuclei usually stops after from 1 to 4 minutes, thereafter only the growth of the nuclei occur, and the nuclei become more stable nuclei. Accordingly, the nucleation step of this invention includes such a step or nuclei growing into more stable nuclei forms. Accordingly, the nucleation can be said to be a seed crystal formation.

Therefore, there is no strict range on the nucleation time but the nucleation time is usually within 20 minutes and in the process of the present invention, the nucleation time is preferably from 5 seconds to 10 minutes.

It is preferred that the aqueous silver salt solution and an aqueous halide solution added to the middle scale apparatus and the large scale apparatus are quickly and uniformly mixed with the reaction solution in each apparatus. For this purpose, it is preferred that the aqueous silver salt solution and the aqueous halide solution are directly added to the reaction solution (i.e., added directly under the liquid surface) and stirred vigorously by stiring blades equipped near the inlet thereof. Also, it is preferred to add the aforesaid solutions through porous members. In particular, in a large scale apparatus, the flow stream bundles of an aqueous silver salt solution and an aqueous halide solution being added become big, thereby the ununiformity of the concentration of the solute near the inlet of them is more increased. This is one reason of the difference in performance caused in the case of increasing the production scale of silver halide emulsion. On the other hand, when the aforesaid solutions are added through a porous material, the ununiformity is greatly improved. The porous material means a material having at least 4, preferably at least 10, and more preferably from $10^2$ to $10^{15}$ pores per one solution being added, the pore size 0f the pores being not larger than 2 mm, preferably form 0.5 mm to 100 Å, and more preferably form 0.1 mm to 0.1 μm. In particular, a hollow tube having a porous film wall is preferred in the point of simplicity and easily usability of it. Details thereof are described in Japanese Patent Application No. Hei-2-78534.

Also, in this invention, as a method of supplying a solute ion being supplied at the case of growing silver halide crystals in the large scale apparatus, a method of supplying a previously prepared very fine grain silver halide emulsion (AgCl, AgBr, AgI and/or a mixed crystals thereof) having sizes of not larger than 0.1 μm is particularly preferred. The very fine silver halide grains are gradually dissolved after being uniformly mixed with a large amount of a silver halide emulsion and also the ununiform distribution of the solution larger than the equilibrium solubility thereof does not occur. Accordingly, it becomes possible to perform the uniform crystal growth of the seed crystals in the large scale apparatus. The very fine silver halide grains are preferably non-defect grains substantially containing no multiple twin grains (grains containing two or more twin planes in one silver halide grain) or helical rearranged grains. In this case, the term "substantially" means that the ratio of the defect grains is less than 5%, and preferably less than 1%. Details of the preparation process of the very fine silver halide grains are described in JP-A-1-183417 and Japanese Patent Application No. Hei-2-142635.

These addition systems and stirring means are described in Japanese Patent Application No. Hei-1-76678, U.S. Pat. Nos. 3,897,935, 3,790,386, 3,415,650, 3,692,283, 4,289,733, and 3,785,777, JP-A-57-92524 and JP-A-60-117834.

As the dispersion medium which is used for the nucleation step, a dispersion medium which is conventionally used for the production of silver halide emulsions can be used and gelatin and hydrophilic colloids as described below can be used but gelatin is preferably used. The concentration of the dispersion medium is usually from 0.1 to 10% by weight.

As the addition method for an aqueous silver salt solution and an aqueous halide solution, a single jet method of adding an aqueous silver salt solution to an aqueous halide solution or a reverse mixing method of adding an aqueous halide solution to an aqueous silver salt solution may be used. However, a method of adding an aqueous silver salt solution and an aqueous halide solution by a double jet method is preferred in that it is thereby possible to keep the saturation at a constant value during the nucleation.

The addition rate of an aqueous silver salt solution is from $2\times10^{-5}$ to $1\times10^{-1}$ mole/minute per liter of the reaction solution.

The preferred conditions such as the addition rate of the aqueous silver salt solution, the concentration of gelatin, pBr of the reaction solution, the temperature of the solution, for example, depend upon the nature of the silver halide emulsion being produced. Also, in the case of producing a parallel double twin grain monodisperse silver halide emulsion, an aqueous silver salt solution and an aqueous halide solution are added to an aqueous gelatin solution (gelatin concentration: 0.1 to 3.0% by weight) by a double jet method at a rate of from $6\times10^{-4}$ to $2.9\times10^{-1}$ mole/minute per liter of the reaction solution while keeping the temperature at 5° to 48° C. and pBr at 1 to 2.5 to form nuclei. The aforesaid techniques which can be employed in this invention are described in JP-A-63-151618, Japanese Patent Application No. Sho-63-315741, and Japanese Patent Application No. Hei-1-90089.

Also, in the case of forming non-twin grain nuclei only, an aqueous silver salt solution and an aqueous halide solution are added by a double jet method at a rate of from $2\times10^{-5}$ to $3\times10^{-2}$ mole/minute per liter of the reaction solution under the conditions that the excessive halogen ion concentration or excessive silver ion concentration is from 0 to $10^{-2.1}$ mole/liter and the gelatin concentration is from 1.0 to 15% by weight to form the nuclei. The aforesaid techniques which can be used in this invention are described in Japanese Patent Application No. Sho-63-223739.

Also, other conventional nucleation conditions for silver halide grains are described in Japanese Patent Application No. Sho-63-223739, JP-A-58-113926, JP-A-58-113927, and JP-A-58-113928, P. Glafkides, *Chimie et Physique Photographiques,* Part 3, Fifth Edition, Edition de l' Usine Nouvelle, Paris, 1987 and V. L. Zelkiman et al, *Making and Coating Photographic Emulsion,* published by The Focal Press, 1964.

Physical Ripening Step

In production of a silver halide emulsion, a ripening step is usually employed. For example, in the case of producing a hexagonal tabular grain monodisperse silver halide emulsion, it is impossible to selectively form only parallel double twin grains during the nucleation and other types of silver halide grain shapes (non-twin grains, single twin grains, non-parallel double twin grains, for example) are also formed. Accordingly, a ripening step is employed for eliminating the other types of grain shapes. Details thereof are described in JP-A-63-151618, Japanese Patent Application No. Sho-63-315741, and Japanese Patent Application No. Hei-1-90089.

Also, after forming regular crystal nuclei, a physical ripening step is sometimes employed for reducing the number of the nuclei. Such a ripening step is described in T. G. Bogg, et al, *Journal of Photographic Science,* 24, 81(1976).

After finishing the crystal growth, a physical ripening step is sometimes added for modifying the form of the crystal grains. Such a physical ripening step is described in JP-A-1-131541.

Since the physical ripening step is usually carried out during stoppage of the addition of solutes or during only low-speed addition of solutes, the difference in physical properties between the small scale apparatus and introduction of the solution to the large scale apparatus is relatively small. Accordingly, in this invention, the ripening step is preferably carried out in a large scale apparatus.

Crystal Growing Step

It is preferred that in the crystal growing step that the addition rate of an aqueous silver salt solution and an aqueous halide solution is slower than the rate of generating new nuclei and faster than the rate of causing Ostwald ripening. This is because the grain size distribution becomes relatively broad since new nuclei also form during the crystal growing period and also if Ostwald ripening occurs. The solutes are usually added at from 30 to 99%, and preferably from 40 to 90% of the critical addition rate. Accordingly, the need for precisely controlling condition of the super saturation degree for the reaction solution at the crystal growth is less the case than at the nucleation. Accordingly, if the nuclei (seed crystals) wherein each factor has been sufficiently controlled are used, even when the crystal growth is carried out in the large scale apparatus, the properties of the silver halide emulsion finally obtained are not significantly different from those of the silver halide emulsion if prepared by performing all the steps in the small scale apparatus. Thus, in this invention, the crystal growth is carried out in the large scale apparatus. Usually, when the supersaturation degree of the solutes in the reaction solution is increased and silver halide grains are grown in a growing mechanism having a large contribution to the diffusion rate-determining growth, a population of silver halide grains having a narrow grain size distribution is preferably obtained.

Suitable addition methods for the addition of silver ions and halogen ions during the crystal growing period include a method of adding an aqueous silver salt solution and an aqueous halide solution, a method of previously adding a very fine grain silver halide emulsion (AgCl, AgBr, AgI and/or the mixed crystal thereof) having grain sizes of less than 0.1 μm, and a method of a combination of these procedures. Also, a method of increasing the addition rate of silver ions and halogen ions during the crystal growth can be used. As the method of increasing the addition rate, the addition rate (flow rate) of an aqueous silver salt solution and an aqueous halide solution each habing a constant concentration may be gradually increased or the concentrations of the aqueous silver salt solution and the aqueous halide solution being added may be gradually increased as described in JP-B-48-36890 and JP-B-52-16364 (the term "J-B" as used herein means an "examined Japanese patent publication"). A combination of the aforesaid methods may be also used.

In the aforesaid case, the addition rate of the silver ions and halogen ions may be increased stepwise or continuously according to the purposes sought.

As the addition method of halogen ions at the formation of mixed crystals, a method of adding an aqueous solution containing at least two of $Cl^-$, $Br^-$, and $I^-$, a method of adding two or more aqueous solutions each containing $Cl^-$, $Br^-$, or $I^-$ as independent addition systems, and a combination thereof can be employed.

In the case of forming silver halide grains having a gradually increasing or gradually decreasing iodine distribution in the grain, the concentration of an iodide in the aqueous halide solution being added may be gradually increased or gradually decreased with the crystal growth, and in the case of forming silver halide grains having a rapidly increasing or decreaseing iodine distribution in the grain, the concentration of an iodide in the aqueous halide solution may be rapidly increased or decreased with the crystal growth. Details thereof are described in Japanese Patent Application No. Sho-63-223739, JP-A-55-142329, JP-A-58-113926, and JP-A-59-45438, U.S. Pat. Nos. 3,650,757 and 4,242,445, and British Patent 1,335,925.

Also, as described in Japanese Patent Application No. Sho-63-223739, an aqueous halide solution is most preferably added according to the previously calculated theoretical formula therein.

The temperature at the crystal growth is usually from 40° to 80° C.

Other Conditions of the Production of Silver Halide Emulsion by the Process of the Invention In the production of a silver halide emulsion by the process of this invention, the pH of the reaction solution in each step is selected in the range of from 1.6 to 10.5 according to the purposes sought.

In the case of producing a surface-fogged type direct reversal silver halide emulsion, it is preferred that the silver halide grains do not contain reduced silver nuclei. In this case, the pH of the reaction solution is preferably 6 or lower, and more preferably from 1.6 to 5.6.

Also, in the case of forming negative working silver halide grains, it is preferred that the silver halide grains contain reduced sensitizing nuclei. In this case, the pH of the reaction solution is preferably in the range of from 5 to 10. However, the preferred pH range depends upon the pBr of the reaction solution, and with the decrease of the concentration of halogen ions or with the increase of silver ions, the pH range at which reductive silver nuclei began to occur shifts to the low pH side.

As the dispersion medium being used in the case of producing a silver halide emulsion by the process of the present invention, any dispersion media which are conventionally used for silver halide emulsions, such as gelatin and various kinds of hydrophilic colloids, can be used. However, gelatin is usually used and as gelatin, alkali-treated gelatin, acid-treated gelatin, gelatin derivatives such as phthalated gelatin, gelatin having a methionine content of not more than 50 mol/g (as described in JP-A-62-157024) and low-molecular weight gelatin (molecular weight of from 2,000 to 100,000, such as enzyme-decomposed gelatin, and gelatin hydrolyzed by an acid or an alkali) can be used. Also, a mixture of these gelatin types can be used. As the gelatin derivatives, there are products obtained by reacting gelatin and various compounds such as acid halides, acid anhydrides, isocyanates, bromoacetic acid, alkanesaltones, vinylsulfonamides, maleinimide compounds, polyalkylene oxides, epoxy compounds, for example.

Other examples of the dispersion medium for use in this invention are graft polymers of gelatin and other polymers; thioether polymers; proteins such as albumin, casein, for example; cellulose derivatives such as hydroxyethyl cellulose, carboxymethyl cellulose, cellulosesulfuric acid ester, for example; sugar derivatives such as sodium alginate, starch derivatives, for example; and various synthetic hydrophilic high molecular weight substances of homopolymers or copolymers such as polyvinyl alcohol, polyvinyl alcohol partial acetal, poly-N-vinyl-pyrrolidone, polyacrylic acid, polymethacrylic acid, polyacrylamide, polyvinyl imidazole, polyvinyl pyrazole, for example.

They can be used singly or as a mixture thereof.

Details of these dispersion media are described in the literature recited hereinafter.

In the present invention, a silver halide solvent can be used for controlling the supersaturation of the solute concentration at the nucleation of the silver halide grains, for accelerating ripening in the ripening step, for accelerating the growth of crystals in the crystal growing step, and/or for effectively performing the chemical sensitization of the silver halide emulsion.

As the silver halide solvent, there are thiocyanates, ammonia, thioethers, thioureas, for example. These materials are also described in the literature recited below.

There is no particular restriction on the additives which can be added to the silver halide emulsion in the production thereof from the formation of the silver halide grains to the coating of the emulsion.

Examples of additives which can be used in this invention are silver halide solvents (ripening accelerator), dopants to silver halide grains (compounds of noble metals belonging to Group 8 of the Periodic Table such as platinum and palladium, compounds of other metals (gold, iron, lead, cadmium, etc.), chalcogen compounds, SCN compounds, for example), dispersion media, antifoggants, stabilizers, sensitizing dyes (for blue sensitization, green sensitization, red sensitization, infrared sensitization, panchromatic sensitization, orthochromatic sensitization, for example), super color sensitizers, chemical sensitizers (chemical sensitizers such as the compounds of sulfur, selenium, tellurium, gold, and noble metals of Group 8, and phosphorus compounds, singly or as a combination thereof, most preferably, chemical sensitizers composed of a combination of the compounds of gold, sulfur, and selenium and reduction sensitizers such as stannous chloride, thiourea dioxide, polyamine, amineborane series compounds, for example), fogging agents (organic fogging agents such as hydrazine series compounds, etc., and inorganic fogging agents), surface active agents (defoaming agents, for example), emulsion sedimenting agents, soluble silver salts (AgSCN, silver phosphate, silver acetate, for example), latent image stabilizers, pressure desensitization inhibitors, thickeners, hardening agents, developing agents (hydroquinone series compounds, for example), and development modifiers.

Practical compounds of these additives and manners of using them are described in the literature recited below.

In this invention, the silver halide emulsions being produced in this invention can use any combinations with the conventional techniques and conventional compounds described in the following literature, such as *Research Disclosure* Vol. 176 (Item 17643) (December, 1978), ibid., Vol. 184 (Item 18431) (August, 1979), ibid, Vol. 216 (Item 21728) (May, 1988), *Journal of Nikka Kyo,* 12, 18–27(1984), *Journal of the Society of Photographic Science and Technology of Japan,* Vol. 49, 7(1986), ibid., Vol. 52, 144–166 (1989), JP-A-58-113926, JP-A-58-113927, JP-A-58-113828, JP-A-59-90842, JP-A-59-142539, JP-A-62-253159, JP-A-62-99751, JP-A-63-151618, JP-A-62-6251, JP-A-62-115053, JP-A-63-305343, JP-A-63-220238, JP-A-62-27731, JP-A-62-269958, JP-A-61-112142, JP-A-62-266538, JP-A-63-220238, JP-A-63-78465, JP-A-1-131541, JP-A-1-297649, JP-A-2-146033, Japanese Patent Application Nos. Sho-63-315741, Sho-62-208241 and Sho-63-311518, JP-B-59-43727, U.S. Pat. No. 4,707,436, T. H. James, *The Theory of The Photographic Process.* Forth Edition, Macmillan, New York, 1977, V. L. Zelikman et al, *Making and Coating Photographic Emulsion* (published by The Focal Press, 1964), P. Glafkides, *Chimie et Physique Photographiques,* Fifth Edition, Edition de l' Usine Nouvelle, Paris, 1987, ibid., Second Edition, Paul Montel, Paris, 1975, and K. R. Hoilister, *Journal of Imaging Science,* 31, 148–156(1987).

Advantages of the Invention

In the case of mass-producing a silver halide photographic emulsion by adding an aqueous silver salt solution and an aqueous halide solution to a reaction solution containing at least a dispersing medium and water, the nucleation of the silver halide emulsion is carried out in a middle scale apparatus and ripening and/or the crystal growth is carried out in a large scale apparatus, thereby the process of this invention has the following features as compared with the conventional case of carrying out the whole process of from the nucleation to the crystal growth in the same large scale apparatus.

(1) A silver halide emulsion having substantially same properties as those of the silver halide emulsion developed in a small scale apparatus for research can be immediately mass-produced.

(2) The control precision of the saturation degree of the reaction solution at the nucleation is fundamentally better in a small scale apparatus. Thus, as described above, in this invention, the silver halide emulsion having high properties, the nucleation of which is more precisely controlled, can be mass-produced. The process of this invention is particularly effective in the case of producing a parallel double twin tabular grain monodisperse silver halide emulsion or a non-twin grain silver halide emulsion.

(3) In the case of producing a silver halide emulsion containing tabular silver halide grains in which at least 70% of the total projected area of the silver halide grains have parallel twin planes, the nucleation is carried out at a low temperature and the subsequent ripening step is carried out at a high temperature. In a conventional technique, in this case, it is required to raise and lower the temperature of a large scale apparatus, which results in consuming large amounts of energy. On the other hand, in the embodiment of this invention as shown in FIG. 1, it is unnecessary to raise and lower the temperature of the large scale apparatus and, hence, the invention is advantageous in the regard of energy saving and speed of operation.

The following examples are intended to illustrate the present invention but are not to be construed to limit it in any way.

EXAMPLE 1

The production apparatus shown in FIG. 1 was used.

Figure 4:
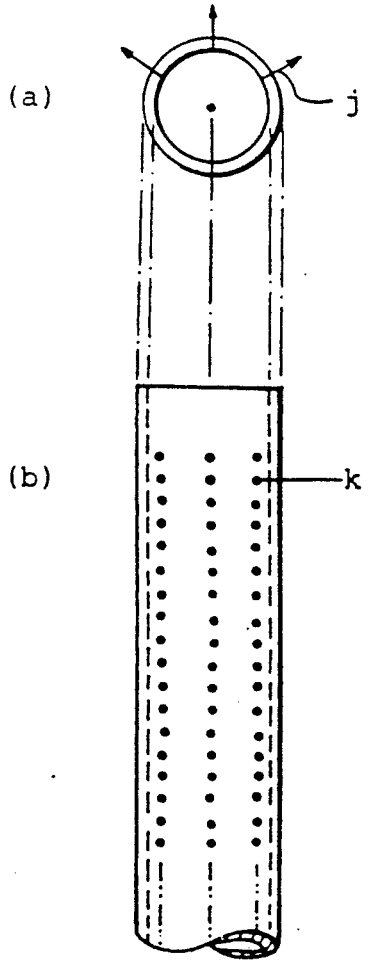
FIG. 4 is a cross-sectional view showing a hollow type porous tube (a) and a schematic view thereof (b).

FIG. 1 is disclosed in JP-A-51-72994, where A represents a middle scale apparatus and E represents a large scale apparatus. In the large scale apparatus E, the addition port of an aqueous silver salt solution and an aqueous halide solution is a hollow porous tube. In addition, D represents a large scale vessel, F, G and H each represents an inlet pipe, and f represents an outlet pipe of waste water after washing the middle scale apparatus A. $Ag^+$ and $X^-$ represent the addition system of an aqueous silver nitrate solution and an aqueous halide solution, respectively. i represents a hollow porous tube, which is shown in FIG. 4 wherein j represents a flow bundle and k represents a fine outlet. The capacity of the reaction vessel of the middle scale apparatus A for nucleation was 40 liters and the capacity of the large scale temporary storage vessel D and the capacity of the additional large reaction vessel or large scale apparatus E for crystal growth were 960 liters.

The middle scale apparatus A and the large scale vessel D were always maintained at 30° C. and the additional large scale apparatus E was always maintained at 75° C. The temperature control was performed by a constant temperature bath. Also, the addition of the aqueous silver salt solution and the aqueous halide solution to the large scale apparatus E and middle scale apparatus A was all carried out through the porous film wall of the hollow tube.

First, an aqueous gelatin solution (24 liters of water, 168 g of low molecular weight gelatin having a mean molecular weight (M) of 20,000, and 108 g of potassium bromide, pH 5.5, 30° C.) was placed in the reaction vessel of the middle scale apparatus A. Then, an aqueous silver nitrate solution (containing 16 g of silver nitrate, 0.7 g of gelatin having M of 20,000, and 0.14 ml of nitric acid (1N) in 100 ml of the solution) and an aqueous potassium bromide solution (containing 12.1 g of potassium bromide and 0.7 g of gelatin having M of 20,000 in 100 ml of the solution) were simultaneously added thereto with stirring in an amount of 1320 ml each by a double jet method at a rate of 1200 ml/min.

After one minute, the reaction solution was transferred into the large scale temporary storage vessel D and then 3360 ml of an aqueous gelatin solution (640 g of deionized alkalitreated gelatin, pH 5.5) was added to the large scale temporary storage vessel D. The middle scale apparatus A was then washed once with water and the water was removed from an outlet f. Then, an aqueous gelatin solution having the same composition was added again to the middle scale apparatus A and then the same procedure as above was repeated 11 times. The time required was 66 minutes.

Then, about 350 liters of the reaction solution thus accumulated in the first large scale vessel D was transferred into the reaction vessel of the additional large scale apparatus E kept at 75° C. When the temperature of the reaction solution thus transferred became 75° C., the product was further ripened for 12 minutes and then 7200 ml of an aqueous silver nitrate solution (15% by weight) was added thereto at 1920 ml/minute.

Then, a mixture of 2256 ml of an aqueous $NH_3$ solution (25% by weight) and 2256 ml of an aqueous ammonium nitrate solution (50% by weight) was added thereto followed by ripening for 20 minutes. Then, an aqueous solution of 3N nitric acid was added thereto to adjust pH to 5.5. Furthermore, 3384 ml of an aqueous potassium bromide solution (10% by weight) was added and then an aqueous silver nitrate solution (15% by weight) and an aqueous potassium bromide solution were added by a controlled double jet method at a silver potential of −20 mV (vs. room temperature saturated calomel electrode). In this case, the aforesaid aqueous silver nitrate solution was first added at 2400 ml/minute for 10 minutes and then at 4320 ml/minute for 20 minutes.

After 2 minutes, the reaction solution was then transferred to a vessel (kept at 30° C.) for sedimentation washing and the emulsion was washed with water by an ordinary sedimentation washing method. Then, 12 kg of gelatin was redispersed therein and pH and pAg thereof were adjusted to 6.4 and 8.6, respectively.

Then, the transmission type electron microphotographic images (TEM images) of the replica of the silver halide grains thus obtained were observed. The result is shown in Table 1 hereinafter.

In the production step, the time required for ripening and crystal growing step in the large scale apparatus E was 72 minutes, which was balanced with the time required for the nucleation, and hence the emulsion was smoothly produced with good reproducibility by self control.

In addition, all the solutions in the steps were directly added into liquid in the mixing box, which is indicated as d in FIGS. 1 to 3.

Comparison Example 1

Nucleation→ripening→crystal growing reaction were carried out using the same reaction vessel having a capacity of 4 liters by employing the same protocol as in Example 1. In this case, however, the scale of the nucleation reaction was 1/20 of that in Example 1 and the scales of ripening and the crystal growing reaction were 1/240 of those in Example 1. Also, the compositions of the solutions added were the same as those of the solutions used in Example 1.

That is, 1.2 liters of an aqueous gelatin solution having the same composition as in Example 1 was placed in the aforesaid single reaction vessel and kept at 30° C. Then, an aqueous silver nitrate solution and an aqueous potassium bromide solution were simultaneously added thereto with stirring in an amont of 66 ml each by a double jet method at a rate of 60 ml/minute. After one minute, 168 ml of an aqueous gelatin solution was added and after mixing uniformly, the temperature of the mixture was raised to 75° C. Then, after ripening for 12 minutes at the temperature, 30 ml of an aqueous silver nitrate solution was added at a rate of 8 ml/minute. Then, a mixture of 9.4 ml of an aqueous $NH_3$ solution and 9.4 ml of an aqueous ammonium nitrate solution was added followed by ripeing for 20 minutes. Then, an aqueous solution of 3N nitric acid was added thereto to adjust pH to 5.5. Then, 14.1 ml of an aqueous potassium bromide solution was added thereto and then an aqueous silver nitrate solution and an aqueous potassium bromide solution were added to the mixture by a controlled double jet method at a silver potential of −20 mV. In this case, the aqueous silver nitrate solution was added first at 10 ml/minute for 10 minutes and then at 18 ml/minute for 20 minutes.

After 2 minutes, the temperature of the product was then lowered to 30° C. and the emulsion obtained was washed with water by an ordinary sedimentation washing method. Then, 50 g of gelatin was redispersed therein and pH and pAg were adjusted to 6.4 and 8.6, respectively.

The TEM images of the replica of the silver halide grains obtained were observed. The result is shown in Table 1.

COMPARISON EXAMPLE 2

The steps form the nucleation to the crystal growth were carried out using the large scale apparatus E only such as shown in FIG. 1. In this case, the procedure was same as that in Comparison Example 1 except that the scale was 240 times that in Comparison Example 1.

The observation results for the silver halide grains obtained is shown in Table 1.

TABLE 1

| | Example 1 | Comparison Example 1 | Comparison Example 2 |
|---|---|---|---|
| Mean Projected Grain Size of Tabular Grain | 1.1 μm | 1.1 μm | 1.0 μm |
| Mean Thickness of Tabular Grain | 0.11 μm | 0.11 μm | 0.11 μm |
| Mean Aspect Ratio of Tabular Grain | 10 | 10 | 9.1 |
| C.V.* of Mean Grain Size Distribution of Tabular Grain | 18.5% | 18.0% | 23% |
| Areal Ratio Occupied by Hexonal Tabular Grains in Whole Tabular Grains | 99.5% | 99.8% | 95% |

*C.V. means a coefficient of variation.

From the results in Table 1, it can be seen that the characteristic values of the high aspect ratio monodisperse tabular silver halide grains prepared in the small scale apparatus for research (Comparison Example 1) were almost the same as those in Example 1 but the characteristic values of the silver halide grains obtained in Comparison Example 2 (conventional method) were considerably inferior to the aforesaid values obtained for Example 1 or Comparison Example 1. Thus, the advantageous effect of the present invention was confirmed by the results shown for Example 1.

In addition, in the nucleation reaction of Example 1, the capacity of the vessel was 10 times that in Comparison Example 1 and the volume of the reaction solution was 20 times that in Comparison Example 1. In other words, since the middle scale vessel is used for the nucleation step only in the practice of the present invention, the capacity of the vessel is more effectively utilized in the present invention.

In addition, the hollow tube type porous film was prepared by making holes having a diameter of 0.1 mm at one hole/2.25 $mm^2$ by slowly inserting a sharp needle into the wall of a Teflon tube. The number of the holes was 100 per one adding system (solution) for the small scale apparatus, 2,000 for the middle scale apparatus, and 2,400 for the large scale apparatus. The other end of the tube is closed with a plug.

While the invention has been described in detail and with reference to specific embodiments thereof, it will be apparent to one skilled in the art that various changes and modifications can be made therein without departing from the spirit and scope thereof.

What is claimed is:

1. A process of producing a silver halide emulsion containing at least a dispersion medium and silver halide grains, which comprises:

carrying out nucleation of the silver halide grains in at least one reaction apparatus having a middle capacity comprising 5 top 500 liters to form a nucleus emulsion, transferring said nucleus emulsion into an intermediate vessel having a large capacity comprising at least 200 liters maintained at a temperature of from 10° to 45° C., which prevents the nuclei from undergoing further physical ripening and/or crystal growth, repeating said nucleation and transferring steps twice or more to accumulate a large amount of the nucleus emulsion in the intermediate vessel, thereafter transferring the nucleus emulsion into a reaction apparatus having a large capacity comprising at least 200 liters, and carrying out physical ripening and/or crystal growth of the nucleus emulsion in said reaction apparatus having a large capacity, wherein a ratio y of the capacities of the large capacity reaction apparatus used for physical ripening and/or crystal growth to the middle capacity reaction apparatus is at least 3.

2. A process of producing a silver halide emulsion as in claim 1, wherein the temperature of the reaction apparatus of a large capacity used for physical ripening and/or crystal growth is kept at 40° to 80° C.

3. A process of producing a silver halide emulsion as in claim 1, wherein the nucleation is carried out at a low temperature from 5° to 48° C. by an equilibrium simultaneous double jet method of an aqueous silver salt solution and an aqueous halide solution, the equilibrium simultaneous double jet method is carried out by a flow rate controlling method without using a silver potential controlling method.

4. A process of producing a silver halide emulsion as in claim 1 wherein during the nucleation and the crystal growth, aqueous silver salt solution and aqueous halide solution are added through a porous material.

5. A process of producing a silver halide emulsion as in claim 1, wherein the silver halide emulsion produced contains silver halide grains wherein at least 70% of the total projection area of the silver halide grains are composed of tabular silver halide grains having parallel twin planes.

6. A process of producing a silver halide emulsion as in claim 1, wherein m number of middle capacity reaction apparatuses are arranged in parallel to the large capacity reaction apparatus used for physical ripening and/or crystal growth with the value of m being from 1 to 30.

7. A process of producing a silver halide emulsion as in claim 1, wherein the middle capacity reaction apparatus is arranged as a multistage batch system with a total period of nucleation t divided into l stages and nucleation is carried out in each stage for a period of about 1/l of the total period of nucleation t.

8. A process of producing a silver halide emulsion as in claim 7, wherein $t/l \geqq 30$ seconds.

9. A process of producing a silver halide emulsion as in claim 7, wherein 2 to 10 multistage batch systems are used in parallel to each other.

10. A process of producing a silver halide emulsion as in claim 1, wherein the middle capacity reaction apparatus has a capacity of from 30 to 200 liters, and the large capacity reaction apparatus has a capacity of 500 to 2,000 liters.

11. A process of producing a silver halide emulsion as in claim 1, wherein the intermediate vessel has a capacity of from 200 to 1,000 liters.

12. A process of producing a silver halide emulsion as in claim 1, wherein y has a value of from 5 to 50.

* * * * *